US006344784B1

(12) United States Patent
Murata et al.

(10) Patent No.: US 6,344,784 B1
(45) Date of Patent: Feb. 5, 2002

(54) COIL COMPONENT

(75) Inventors: Satoshi Murata, Yokaichi; Hideyuki Mihara, Shiga-ken; Etsuji Yamamoto; Minoru Tamada, both of Yokaichi, all of (JP)

(73) Assignee: Murata Manufacturing Co., LTD, Kyoto (JP)

( * ) Notice: Subject to any disclaimer, the term of this patent is extended or adjusted under 35 U.S.C. 154(b) by 0 days.

(21) Appl. No.: 09/642,306

(22) Filed: Aug. 21, 2000

(30) Foreign Application Priority Data

Aug. 19, 1999 (JP) ..... 11-232958
Dec. 8, 1999 (JP) ..... 11-349030

(51) Int. Cl.[7] ..... H01F 27/02
(52) U.S. Cl. ..... 336/83; 336/192; 336/200
(58) Field of Search ..... 336/83, 192, 200, 336/223, 232; 257/531; 29/602.1

(56) References Cited

U.S. PATENT DOCUMENTS 6,087,920 A * 7/2000 Abramov ..... 336/192
6,087,921 A * 7/2000 Morrison ..... 336/200
6,094,123 A * 7/2000 Roy ..... 336/200
6,157,283 A * 12/2000 Tsunemi ..... 336/192

FOREIGN PATENT DOCUMENTS

DE 888271 8/1953
JP 05041324 2/1993

* cited by examiner

*Primary Examiner*—Lincoln Donovan
*Assistant Examiner*—Tuyen T. Nguyen
(74) *Attorney, Agent, or Firm*—Keating & Bennett, LLP

(57) ABSTRACT

A coil component includes a conductor film provided on the surface of a core having flanges. On one flange, first and second dividing grooves and a connecting groove are provided, whereby first and second terminals are defined. On the other flange, third and fifth dividing grooves and a connecting groove are provided, whereby third and fourth terminals are defined. First and second winding-around grooves are connected to the respective dividing grooves and arranged substantially parallel to each other. A coil connected to the first and third terminals and a coil connected to the second and fourth terminals are also provided.

16 Claims, 13 Drawing Sheets

COIL COMPONENT

BACKGROUND OF THE INVENTION

1. Field of the Invention

The present invention relates to a coil component for use in an inductor, a choke coil, an LC filter, a transformer, a balun transformer, and other suitable components, and more particularly, to a coil component having a coil that is formed by removing a portion of a conductor provided on the surface of a core via a laser beam.

2. Description of the Related Art

A coil component disclosed in Japanese Unexamined Patent Application Publication No. 5-41324 will be described as an example of a conventional coil component with reference to FIG. 20.

In FIG. 20, a solenoid coil 100 includes a columnar bobbin 101 made of an insulation magnetic material such as ferrite. A conductor film 102 is located on the surface of the bobbin 101. A spirally winding groove 103 is formed via a laser beam. The remaining portion of the conductor film 102 defines a coil 104.

Further, Japanese Unexamined Patent Application Publication No. 5-41324 describes the possibility that at least two pairs of coils can be formed by cutting the conductor film in a similar manner as described above.

In the conventional device having a plurality of coils, there is no specific, efficient method for forming and providing the spiral grooves defining the respective coils and the terminals for connecting the coils.

SUMMARY OF THE INVENTION

Accordingly, to solve the problems described above, preferred embodiments of the present invention provide a coil component having a unique arrangement and method of arranging a plurality of coils and a plurality of terminals connected to the plurality of coils.

According to a preferred embodiment of the present invention, a coil component having a coil formed by removal of a portion of a conductor film provided on a columnar core which includes first and second terminals insulated from each other, provided in the conductor film on one end portion of the core by formation of a first dividing groove and a second dividing groove in the conductor film, third and fourth terminals insulated from each other, provided in the conductor film on the other end portion of the core by formation of a third dividing groove and a fourth dividing groove in the conductor film, a first winding-around groove provided on the conductor film and extending from the first dividing groove to the third or fourth dividing groove continuously with the first and third or fourth dividing grooves, a second winding-around groove provided on the conductor film and extending from the second dividing groove to the fourth or third dividing groove continuously with the second and fourth or third dividing grooves, arranged substantially parallel to the first winding-around groove, and a first coil and a second coil arranged substantially parallel to each other defined by the first and second winding-around grooves.

Other features, elements, characteristics and advantages of the present invention will become more apparent from the detailed description of preferred embodiments thereof with reference to the attached drawings.

DETAILED DESCRIPTION OF PREFERRED EMBODIMENTS

Hereinafter, a coil component according to a first preferred embodiment of the present invention will be described.

Figure 1:
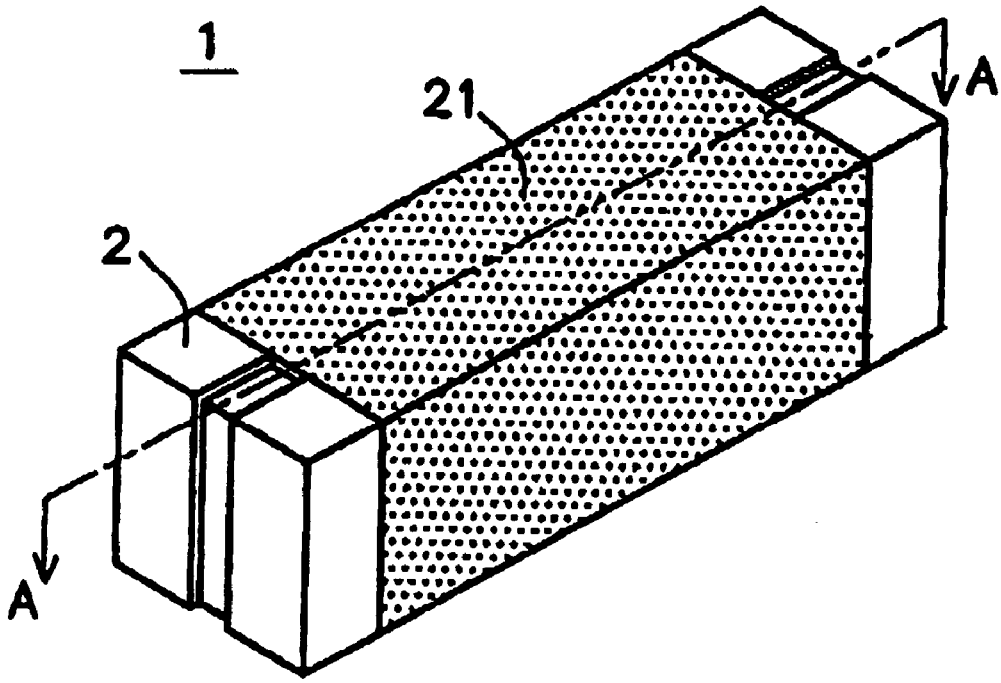
FIG. 1 is a perspective view of a coil component according to a preferred embodiment of the present invention.

In FIG. 1, a coil component 1 preferably includes a core 2 preferably made of ferrite, and an outer covering film 21 that covers a portion of the core 2.

Figure 2A:
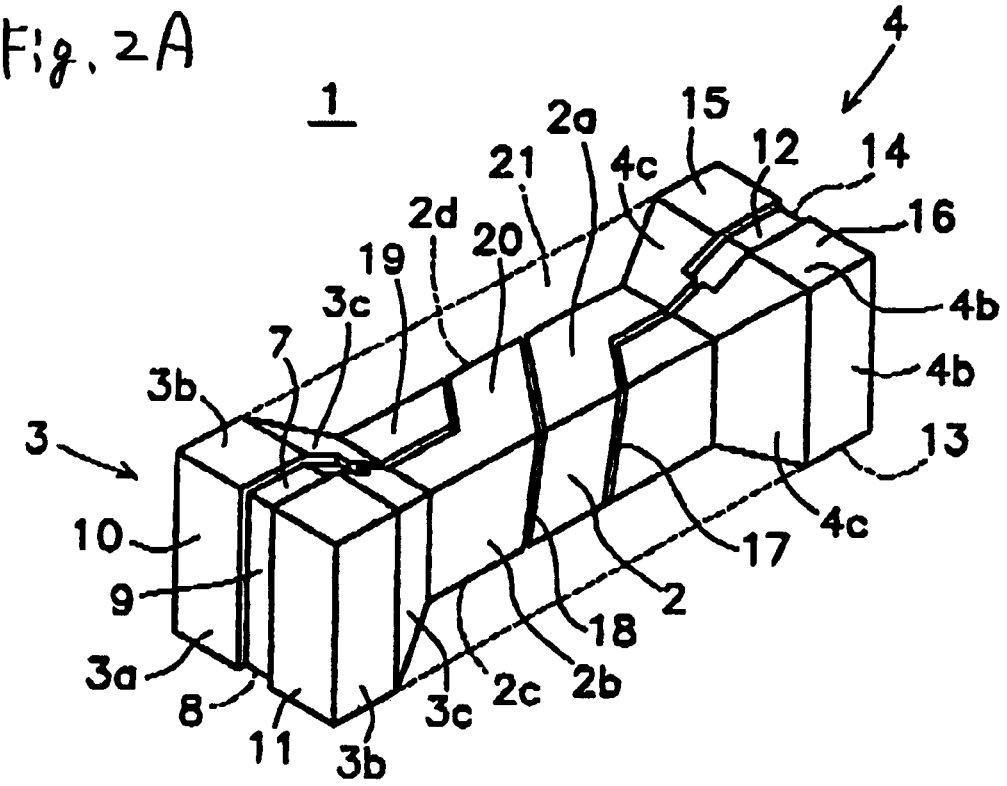
FIG. 2A is a partially perspective view of the coil component of FIG. 1 viewed from one end side in the longitudinal direction of the coil component.
Figure 2B:
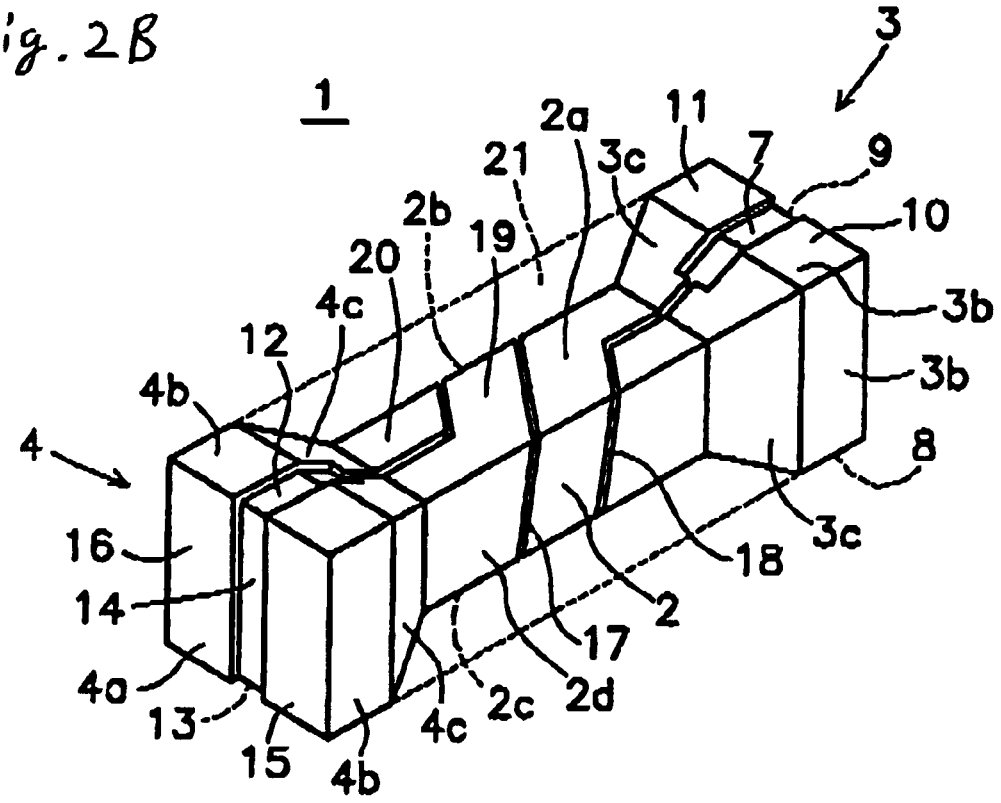
FIG. 2B is a partially perspective view of the coil component of FIG. 1 viewed from the other end side in the longitudinal direction of the coil component.

The core 2 preferably has a substantially quadratic prism shape with four side surfaces 2*a,* 2*b,* 2*c,* and 2*d,* as shown in FIGS. 2A and 2B. In one end portion and the other end portion of the core 2, flanges 3 and 4 are provided and preferably have a substantially-drum shaped configuration protruding in the radial direction of the core 2. The flange 3 has an end surface 3*a,* four side surfaces 3*b* that are substantially parallel to the respective side surfaces of the core 2, and four inclined surfaces 3*c* inclined with respect to the radial direction of the core 2. Similarly, the flange 4 has an end surface 4*a,* four side surfaces 4*b,* and four inclined surfaces 4*c.*

In the flange 3, a first terminal 10 and a second terminal 11 are defined by forming a first dividing groove 7, a second dividing groove 8, and a first connecting groove 9. In the flange 4, a third terminal 15 and a fourth terminal 16 are defined by forming a third dividing groove 12, a fourth dividing groove 13, and a second connecting groove 14. In the portion of the core 2 sandwiched between the flanges 3 and 4, a first coil 19 and a second coil 20 are defined by forming a first winding-around groove 17 and a second winding-around groove 18.

Figure 3:
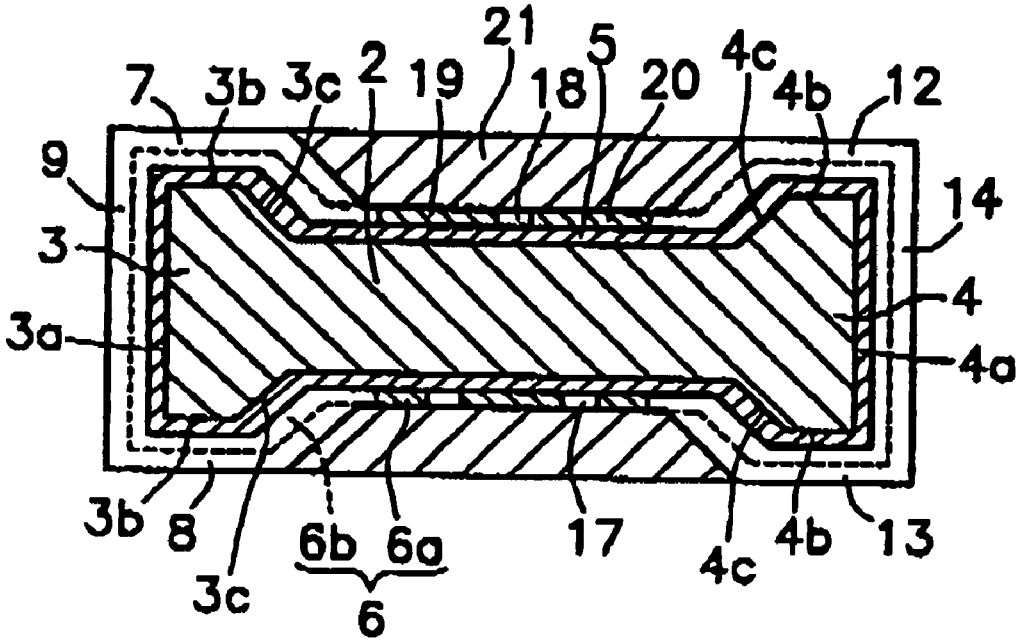
FIG. 3 is a cross-sectional view of the coil component of FIG. 1 taken along a cut line A—A in FIG. 1.

As shown in FIG. 3, a coat film 5 made of glass is provided on the surface of the core 2. Further, a conductor film 6 is provided on the coat film 5. The coat film 6 includes a first conductor film 6*a* disposed on the entire surface of the core 2, and a second conductor film 6*b* overlapping the first conductor film 6*a* in the flanges 3 and 4. In the cross-section of FIG. 3, a portion of the first conductor film 6*a* and the entire second conductor film 6*b* are not shown, since they are removed by the respective dividing grooves 7, 8, 12, and 13, and the first and second winding-around grooves 17 and 18.

The first conductor film 6*a* preferably includes copper or nickel plating formed by an electroless plating method and copper plating formed thereon by an electroplating method. The two plating-layers are provided as described above to reliably provide a predetermined thickness. Accordingly, if a plating having a predetermined thickness can be formed, it is not necessary to provide two overlapped plating layers. For example, copper plating may be formed so as to have a desired thickness by electroplating once.

The second conductor film 6*b* includes nickel plating formed on the first conductor film 6*a* by electroless plating, and a tin plating formed thereon by electroplating.

Figure 4:
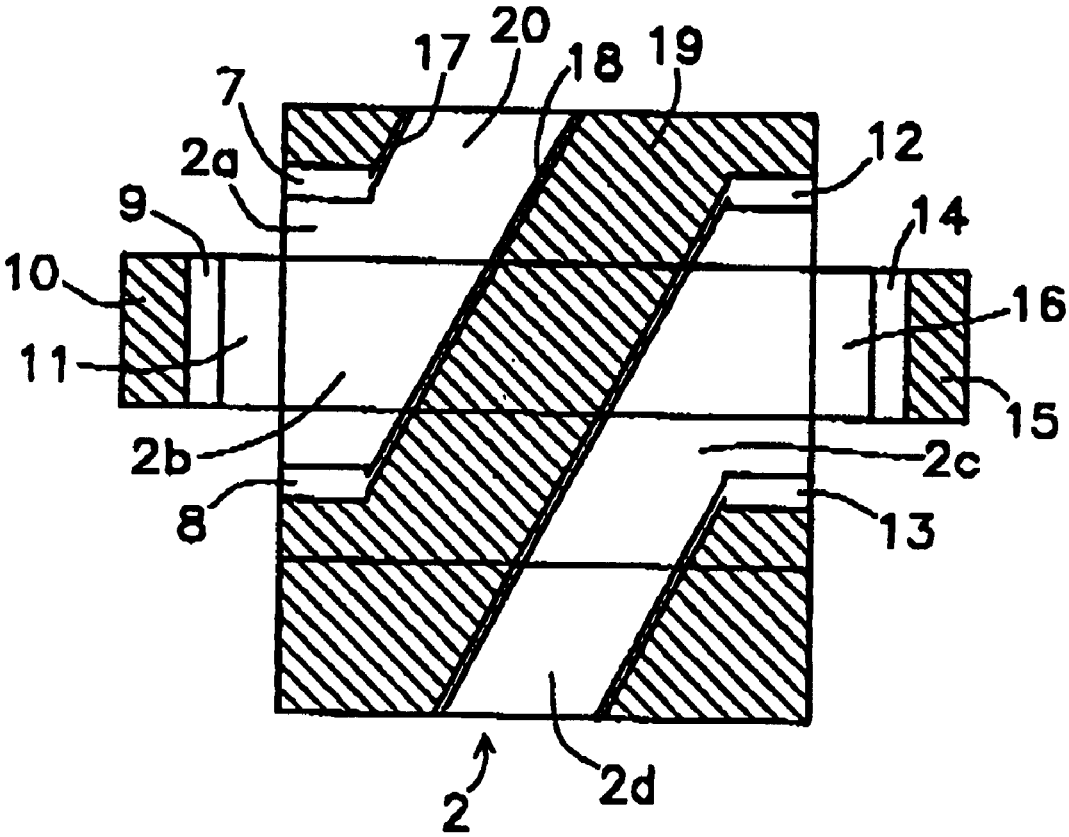
FIG. 4 is a developed schematic view of the coil component of FIG. 1.

A portion of the conductor film 6 is irradiated with a laser beam. The respective grooves are formed by removing the irradiated portion. Hereinafter, the configurations of the respective grooves will be described with reference to FIGS. 2A and 2B, and FIG. 4. FIG. 4 shows the core 2 developed in order to facilitate the understanding of the configurations. The flanges 3 and 4 are shown assuming that they are on the same plane as the core without the concavities and convexities of the flanges being shown.

In the flange 3, the first dividing groove 7 and the second dividing groove 8 are formed in the second conductor film 6*b,* elongating on a pair of the opposed side surfaces 3*b* and a pair of the inclined surfaces 3*c.* In the end surface 3*a,* a connecting groove 9 is arranged to connect the first and second dividing grooves 7 and 8 to each other. These grooves divide the second conductor film 6*b* in the flange 3 to define the first terminal 10 and the second terminal 11 that are arranged to be insulated from each other.

Further, in the flange 4, the third dividing groove 12 and the fourth dividing groove 13 are formed in the second conductor film 6*b,* and extend on a pair of the opposed side surfaces 4*b* and a pair of the inclined surfaces 4*c.* In the end surface 4*a,* the connecting groove 14 connecting the third and fourth dividing grooves 12 and 13 to each other, is formed. With these grooves, the third terminal 15 and the fourth terminal 16 being insulated from each other are defined.

Further, the first winding-around groove 17 and the second winding-around groove 18 arranged substantially parallel to each other are formed in the first conductor film 6*a* on the respective side surfaces of the core 2. One end of the first winding-around groove 17 is connected to the first dividing groove 7 on the inclined surface 3*c* of the flange 3, and the other end is connected to the third dividing groove 12 on the inclined surface 4*c* of the flange 4. Further, one end of the second winding-around groove 18 is connected to the second dividing groove 8 on the inclined surface 3*c* of the flange 3, and the other end is connected to the fourth dividing groove 13 of the inclined surface 4*c* of the flange 4.

The width of the respective dividing grooves 7, 8, 12, and 13 is preferably larger than that of the respective winding-around grooves 17 and 18. For this reason, in the case where the winding-around grooves are formed so as to be continuous with the dividing grooves, the winding-around grooves can be securely connected to the dividing grooves, respectively, even if the irradiation position of the laser beam deviates, provided that the deviation is within a predetermined range.

With the first and second winding-around grooves 17 and 18, the first coil 19 and the second coil 20 are defined to be substantially parallel to each other. In FIG. 4, the first coil 19 is shadowed for easy discrimination of the first and second coils 19 and 20. The first coil 19, one end of which is connected to the terminal 10, is wound around the side surfaces 2*a,* 2*d,* 2*c,* and 2*b* of the core 2, and the other end is connected to the third terminal 15. On the other hand, the second coil 20, one end of which is connected to the second terminal 11, is wound around the side surfaces of 2*b,* 2*a,* 2*d,* and 2*c,* and the other end is connected to the fourth terminal 16.

By irradiating using a laser beam, the grooves are formed only in the first and second conductor films 6*a* and 6*b,* whereby the coils 19 and 20 are formed. In actual manufacturing processes, the bottoms of the grooves may reach the surface of the coat film 5 or core 2. If the surface portion of the core is removed by irradiation of a laser beam in this manner, the insulation resistance of the ferrite constituting the core is reduced. However, the reduced insulation resistance is compensated by the insulation resistance of the glass constituting the coat film 5. Accordingly, a characteristic of the coil component 1 can be set at a desired value.

The portion of the core 2 sandwiched between the flanges 3 and 4 is provided with the outer cover 21 preferably made of resin to protect the coils 19 and 20. The surface of the outer cover film 21 is on the same plane as that of the second conductor film 6*b* provided on the flanges 3 and 4. As a whole, the differences in height between the flanges 3, 4 and the core 2 are eliminated, so that the coil component 1 has a substantially quadratic prism shape.

The coil component 1 is a surface mounting type, and is mounted by use of the side surfaces 3*b* and 4*b* of the flanges 3 and 4 having the first and third dividing grooves 7 and 12 formed therein, respectively, or the side surfaces 3*b* and 4*b* having the second and fourth dividing grooves 8 and 13 formed therein, respectively, as mounting surfaces. Though not specifically shown, if a concavity or convexity for indicating the directivity is formed on one or the other end of the core 2, that is, on the flange 3 or 4, formation of the electrodes and the coils, and mounting of the component can be properly performed.

The first to fourth dividing grooves 7, 8, 12, and 13 are further elongated on the inclined surfaces 3*c* and 4*c* of the flanges 3 and 4, respectively. The boundaries between these dividing grooves and the first and second winding-around grooves 17 and 18 are disposed on the inclined surfaces 3*c* and 4*c*, respectively. Accordingly, each of the first and second coils 19 and 20 are completely covered with the outer covering film 21 from one end thereof to the other end, not exposed to the mounting surface, so as to be protected.

Figure 5:
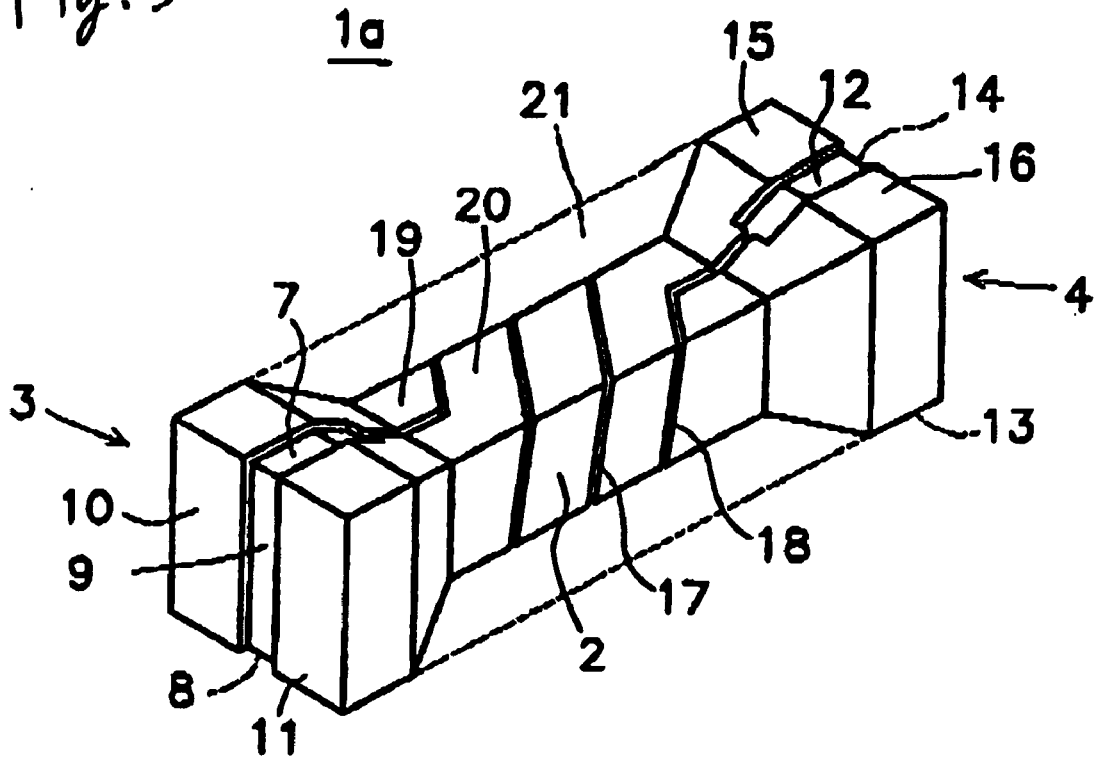
FIG. 5 is a perspective view showing a portion of the coil component according to another preferred embodiment of the present invention.

FIG. 5 shows a modification example of the above-described preferred embodiment. In a coil component 1*a* of FIG. 5, the connection between the respective terminals and the coils is different from that in the above-described example of preferred embodiments of the present invention. One end of the first coil 19 is connected to the first terminal 10, and the other end is connected to the fourth terminal 16. Further, one end of the second coil 20 is connected to the second terminal 11, and the other end is connected to the third terminal 15. The other configuration is preferably the same as that of the coil component 1, and the description of this portion is omitted to avoid repetition.

For mounting of the coil component 1*a* configured as described above, the side surfaces 3*b* and 4*b* of the flanges 3 and 4 having the first and third dividing grooves 7 and 12 formed therein, respectively, or the side surfaces 3*b* and 4*b* having the second and fourth dividing grooves 8 and 13 formed therein, respectively, may be used as mounting surfaces. Further, the side surfaces 3*b* and 4*b* of the flanges 3 and 4 that do not have the first to fourth dividing grooves 7, 8, 12, and 13 formed therein, respectively, may also be used as mounting surfaces.

Figure 6:
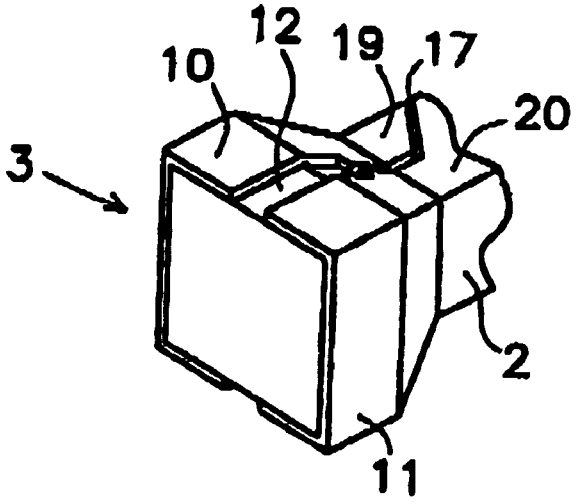
FIG. 6 is a perspective view showing a portion of the coil component according to still a further preferred embodiment of the present invention.

Further, as shown in FIG. 6, the conductor films may be eliminated from the side surfaces 3*a* and 4*a* of the flanges 3 and 4. That is, the first and second terminals 10 and 11 may be arranged so as not to extend on the end surfaces 3*a* and 4*a*, respectively.

In FIG. 6, only the flange 3 is shown. The third and fourth terminals 15 and 16 may be formed similarly to the first and second terminals 10 and 11.

A further preferred embodiment of the present invention will be described.

Figure 7:
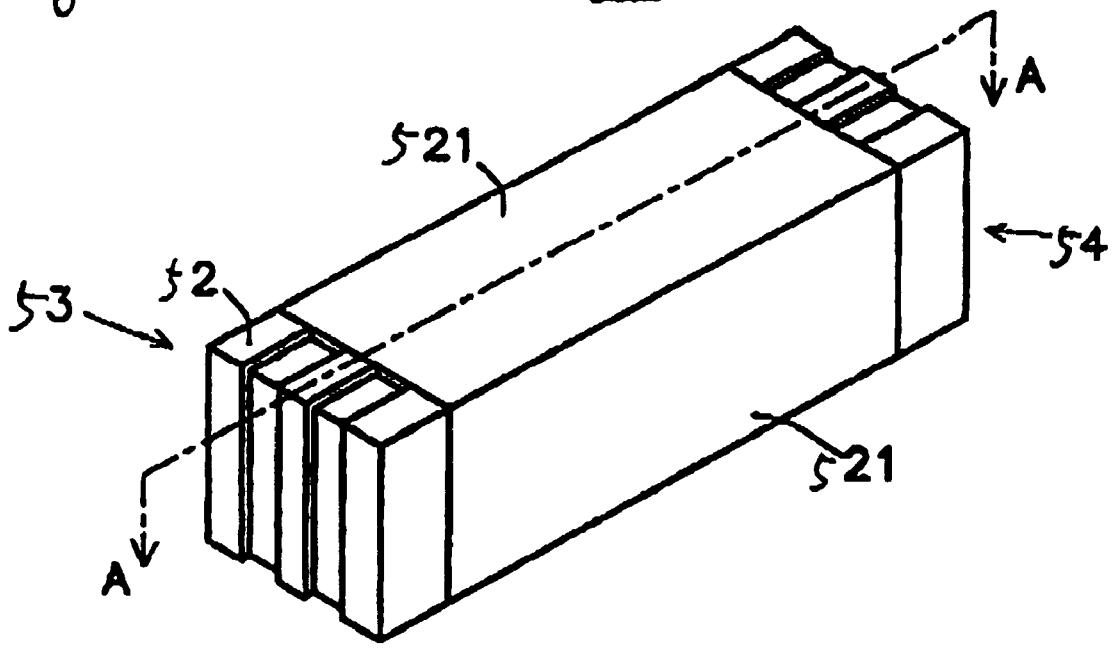
FIG. 7 is a perspective view showing a coil component according to another preferred embodiment of the present invention.

In FIG. 7, a coil component 51 preferably includes a core 52 made of ferrite, and an outer covering film 521 which covers a part of the core 52.

Figure 8A:
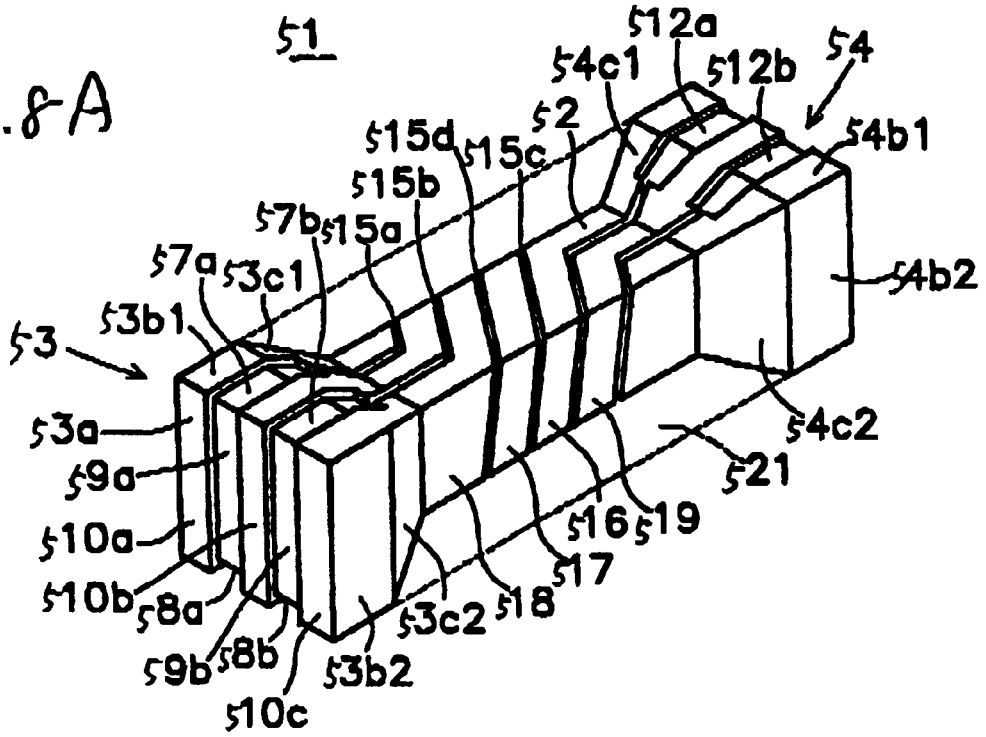
FIG. 8A is a partially perspective view of the coil component of FIG. 7, viewed from one end in the longitudinal direction of the coil component.
Figure 8B:
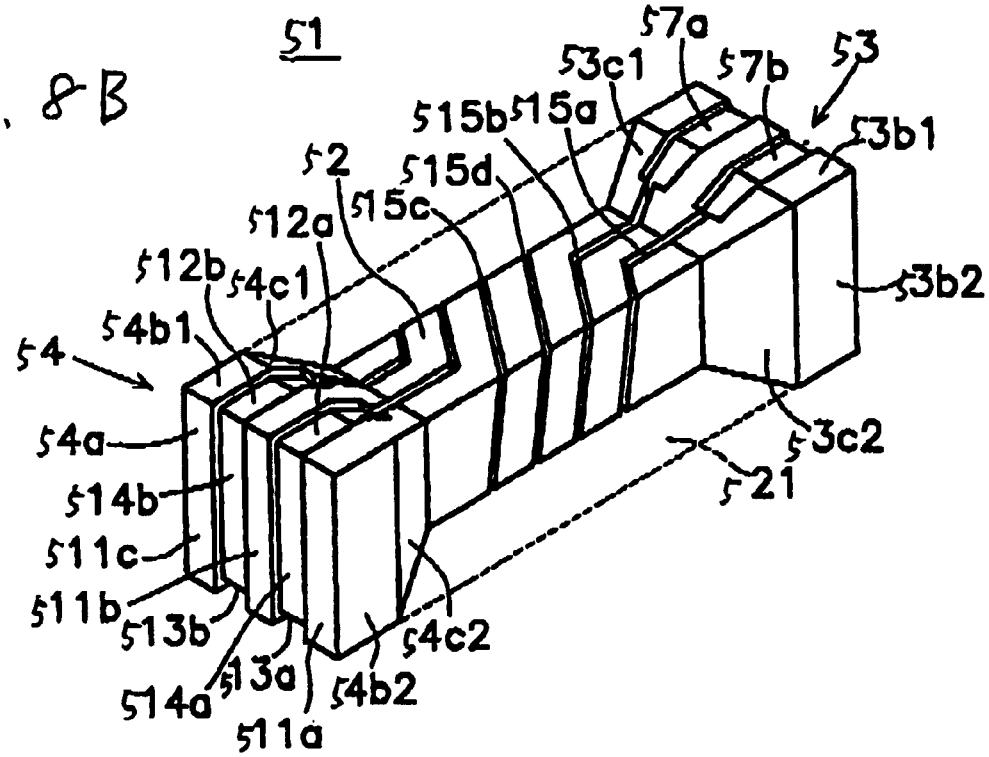
FIG. 8B is a partially perspective view of the coil component of FIG. 7, viewed from the other end in the longitudinal direction of the coil component.

The core 52 preferably has a substantially quadratic prism shape with four side surfaces 52*a*, 52*b*, 52*c*, and 52*d*, as shown in FIGS. 8A and 8B. In one end and the other end of the core 52, flanges 53 and 54 are provided and each having a substantially drum shape protruding in the radial direction of the core 52. The flange 53 has an end surface 53*a*, a pair of side surfaces 53*b*1 and a pair of side surfaces 53*b*2 arranged substantially parallel to the respective side surfaces of the core 52, and a pair of inclined surfaces 53*c*1 and a pair of inclined surfaces 53*c*2 which are continuous with the respective side surfaces of the core 52 and inclined with respect to the axial direction of the core 52. Similarly, the flange 54 has an end surface 54*a*, side surfaces 54*b*1 and 54*b*2, and inclined surfaces 54*c*1 and 54*c*2.

In the flange 53, a first terminal 510*a*, a second terminal 510*b*, and a third terminal 510*c* are formed by providing first dividing grooves 57*a* and 57*b*, and second dividing grooves 58*a* and 58*b*, and first connecting grooves 59*a* and 59*b*. In the flange 54, a fourth terminal 511*a*, a fifth terminal 511*b*, and a sixth terminal 511*c* are formed by providing third dividing grooves 512*a* and 512*b*, fourth dividing grooves 513*a* and 513*b*, and second connecting grooves 514*a* and 514*b*, respectively. In the portion of the core 52 sandwiched between the flanges 53 and 54, first to fourth coils 516 to 519 are formed by providing first to fourth winding-around grooves 515*a* to 515*d*.

Figure 9:
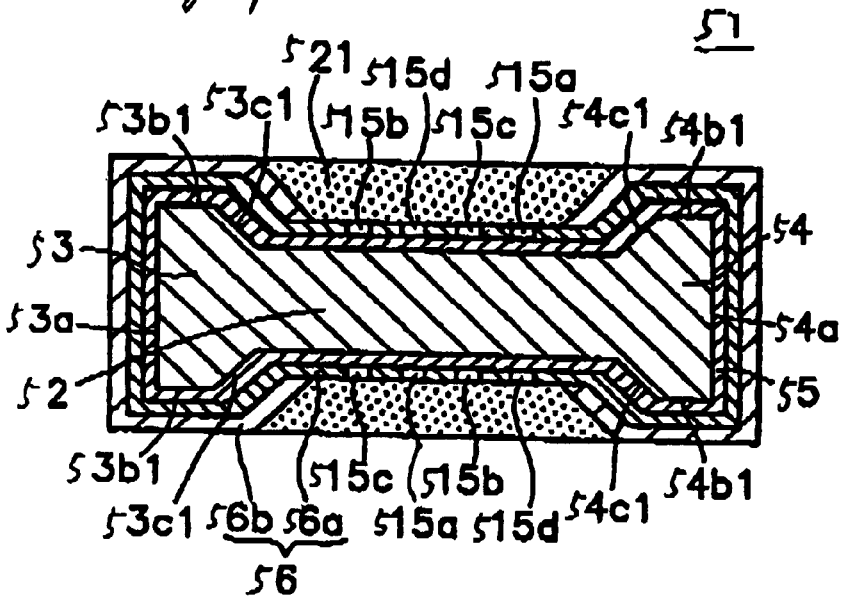
FIG. 9 is a cross-sectional view of the coil component of FIG. 7 taken along cut line A—A in FIG. 7.

As shown in FIG. 9, a coat film 55 made of glass is provided on the surface of the core 52. Further, a conductor film 56 is disposed on the coat film 55. The conductor film 56 preferably includes a first conductor film 56*a* disposed on the entire surface of the core 52, and a second conductor film 56*b* overlapping the first conductor film 56*a* in the flanges 53 and 54.

The first conductor film 56*a* preferably includes copper or nickel plating formed by an electroless plating method and a copper plating formed thereon by an electroplating method. The two plating-layers are provided as described above to assure a predetermined thickness. Accordingly, if a plating having a predetermined thickness can be formed, it is not necessary to provide two overlapped plating layers. For example, copper plating may be formed so as to have a desired thickness by electroplating.

The second conductor film 56*b* preferably includes nickel plating provided on the first conductor film 56*a* by electroless plating, and tin plating provided thereon by electroplating.

Figure 10:
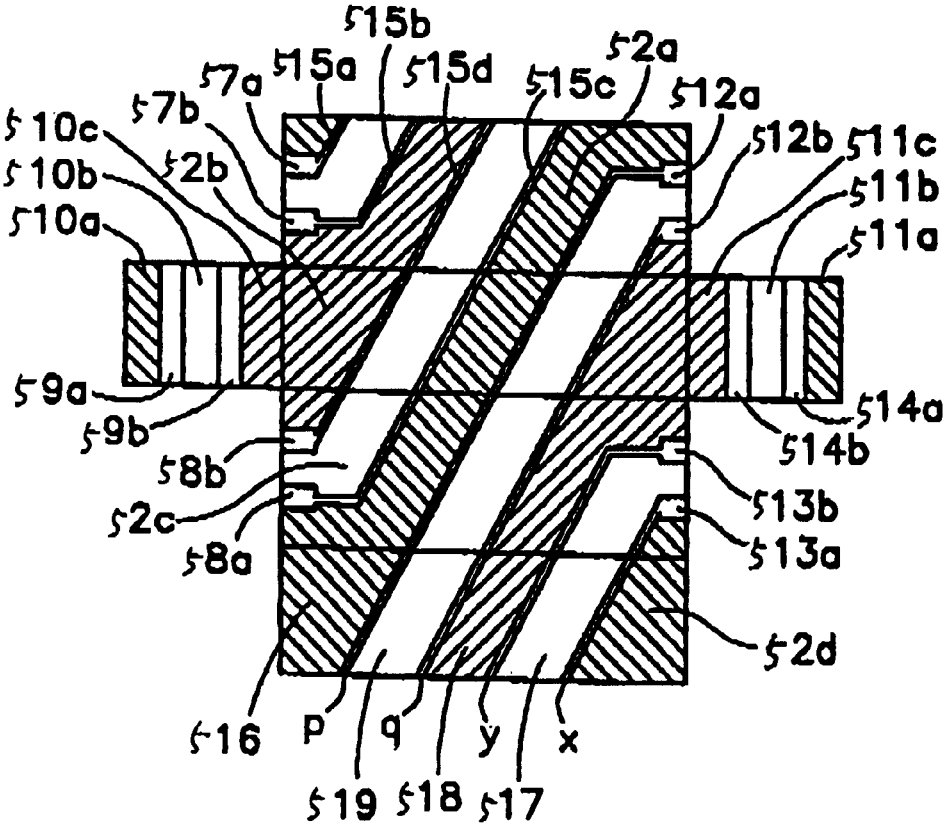
FIG. 10 is a developed schematic view of the coil component of FIG. 7.

A portion of the conductor film 56 is irradiated with a laser beam. The respective grooves are formed by removing the irradiated portion. Hereinafter, the configurations of the respective grooves will be described with reference to FIGS. 8A, 8B, and FIG. 10. FIG. 10 shows the core 52 developed in order to facilitate the understanding of the configurations. Flanges 53 and 54 are shown assuming that they are on the same plane as the core without the concavities and convexities of the flanges 53 and 54 being shown.

In the flange 53, the first dividing grooves 57*a* and 57*b* and the second dividing grooves 58*a* and 58*b* are formed in the second conductor film 56*b*, extending on a pair of the opposed side surfaces 53*b*1 and a pair of the inclined surfaces 53*c*1. In the end surface 53*a*, connecting grooves 59*a* and 59*b* are arranged to connect the dividing grooves to each other. With these dividing and connecting grooves, first, second, and third terminals 510*a*, 510*b*, and 510*c* which are insulated from each other are provided in the flange 53.

Further, in the flange 54, the third dividing grooves 512*a* and 512*b* and the fourth dividing grooves 513*a* and 513*b* are formed in the second conductor film 56*b*, extending on a pair of the opposed side surfaces 54*b*1 and a pair of the inclined surfaces 54*c*1, respectively. In the end surface 4*a*, the connecting grooves 514*a* and 514*b* connecting the dividing grooves to each other, are formed. With these grooves, fourth, fifth, and sixth terminals 511*a*, 511*b*, and 511*c*, which are insulated from each other, are formed in the flange 54.

Further, first to fourth winding-around grooves 515*a* to 515*d*, winding around the core 52 so as to not cross each other, are formed in the first conductor film 56*a* on the respective side surfaces of the core 52. The first winding-around groove 515*a* is elongated from the end of the first dividing groove 57*a* on the inclined surface 53*c*1 of the flange 53 onto the side surface 52*a* of the core 52, and via the point P on the tangential line between the side surface 52*a* and the side surface 52*d* of the core 52, passed through the side surfaces 52*d*, 52*c*, and 52*b*, returned to the side surface 52*a*, and connected to the third dividing groove 512*a* on the inclined surface 54*c*1 of the flange 54. Further, the second winding-around groove 515*b* is elongated from the end of the first dividing groove 57*b* on the inclined surface 53*c*1 of the flange 53, passed through the side surface 52*a* of the core 52, and via the point q, passed through the side surfaces 52*d*, 52*c*, and 52*b*, and connected to the third dividing groove 512*b* on the inclined surface 54*c*1 of the flange 54.

The third winding-around groove 515*c* is elongated from the end of the second dividing groove 58*a* on the inclined surface 53*c*1 of the flange 53 onto the side surface 52*c* of the core 52, passed through the side surfaces 52*b* and 52*a*, and via the point x on the tangential line between the side surfaces 52*a* and 52*d* of the core 52, passed through the side surfaces 52*d*, returned to the side surface 52*c*, and connected to the fourth dividing groove 513*a* on the inclined surface 54*c*1 of the flange 54. The fourth winding-around groove 515*d* is elongated from the end of the second dividing groove 58*b*, passed through the side surfaces 52*c*, 52*b*, and 52*a* of the core 52, and via the point y, connected to the fourth dividing groove 513*b*.

The widths of the first to fourth dividing grooves 57*a*, 57*b*, 58*a*, 58*b*, 512*a*, 512*b*, 513*a*, and 513*b* are preferably larger than those of the first to fourth winding-around grooves 515*a* to 515*d*, respectively. For this reason, in the case where the winding-around grooves are formed via a laser beam, the winding-around grooves are securely connected to the dividing grooves, respectively, even if the irradiation position of the laser beam is deviated, provided that the deviation is within a predetermined range.

With the first to fourth winding-around grooves 515*a* to 515*d*, first to fourth coils 516 to 519 are arranged so as not to cross each other. In FIG. 10, for easy discrimination of the first to fourth coils 516 to 519, the respective coils are shadowed. The first coil 516, one end of which is connected to the first terminal 510*a*, is wound around the core 52 from the side surface 52*d* of the core 52 and through the side surfaces 52*c* and 52*b*, and the other end is connected to the fourth terminal 511*a* on the side surface 52*a*. Further, the second coil 517, one end of which is connected to the second terminal 510*b*, is wound around the side surfaces 52*c*, 52*b*, and 52*a* of the core 52, and via the side surface 52*d*, returned to the surface 52*c*, and the other end is connected to the fifth terminal 511*b*. Further, the third coil 518, one end of which is connected to the third terminal 510*c*, is wound around the side surfaces 52*b*, 52*a*, 52*d*, and 52*c* of the core 52, and the other end is connected to the sixth terminal 511*c*. Further, the fourth coil 519, one end of which is connected to the second terminal 510*b*, is wound around the side surfaces 52*a*, 52*d*, 52*c*, and 52*b* of the core 52, and returned to the side surface 52*a*. The other end is connected to the fifth terminal 511*b*. Both ends of the second coil 517 and both ends of the fourth coil 519 are connected to each other via the second terminal 510*b* and the fifth terminal 511*b*, respectively, so as to be integrated with each other.

Figure 11:
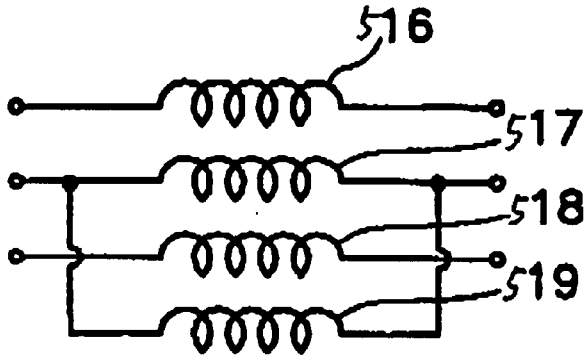
FIG. 11 is an equivalent circuit diagram of the coil component of FIG. 7.

FIG. 11 shows an equivalent circuit for the coil component 51. In FIG. 11, the first to the third coils 516 to 518 define independent coils. The fourth coil 519 is connected in parallel to the second coil 517.

In the coil component 51, the first to the fourth coils 516 to 519 are preferably arranged substantially parallel to each other. Accordingly, the coupling degrees between the coils are high, and the distributed capacitances between the coils are equally generated. Thus, a distributed constant type of coil component can be realized.

In the second coil 517 and the fourth coil 519 which are integral with each other, the same current-carrying capacity can be obtained even if the widths of the coils are reduced to half thereof, respectively. Accordingly, the area of the core 52 occupied by the conductor can be decreased. That is, the size of the coil component 51 can be reduced. If the widths of the coils are not changed, twice as much current-carrying capacity can be obtained.

By irradiation of a laser beam, grooves are formed only in the first and second conductor films 56*a* and 56*b*, whereby the first to fourth coils 516 to 519 are defined. In actual manufacturing processes, the bottoms of the grooves may reach the surface of the coat film 55 or core 52. If the surface portion of the core is removed by irradiation of a laser beam, the insulation resistance of the ferrite constituting the core is reduced. However, the reduced insulation resistance is compensated by the insulation resistance of the glass constituting the coat film 55. Accordingly, a desired value of a characteristic of the coil component 51 can be accurately achieved.

The portion of the core 52 sandwiched between the flanges 53 and 54 is provided with an outer cover 521 made of resin to protect the first to fourth coils 516 to 519. The surface of the outer cover film 521 is on the same plane as the surface of the flanges 53 and 54, that is, that of the second conductor film 56*b* provided on the flanges 53 and 54. As a whole, the differences in height between the flanges 53, 54 and the core 52 are eliminated, so that the coil component 51 has a substantially quadratic prism shape.

The coil component 51 is a surface mounting type, and is mounted by use of the side surface 53*b*1 of the flange 53 having the first dividing grooves 57*a* and 57*b* formed therein and also the side surface 54*b*1 of the flange 54 having the third dividing grooves 512*a* and 512*b* formed therein as mounting surfaces. Further, the side surfaces 53*b*1 of the flange 53 having the second dividing grooves 58*a* and 58*b* formed therein, and the side surfaces 54*b*1 of the flange 54 having the fourth dividing grooves 513*a* and 513*b* formed therein may be used as mounting surfaces.

The end surfaces 53*a* and 54*a* of the flanges 53 and 54 have a substantially quadrangle shape, and preferably a rectangle shape. Hence, the electrical directivity can be easily discriminated. When the core 52 is fed to a working machine in the laser working process for forming the respective winding-around grooves, the directivity can be discriminated securely and accurately. In addition, when mounting onto a printed-circuit board, the discrimination of the directivity can be easily performed. Moreover, a concavity or convexity (not shown) may be formed on one or the other end of the core 52, that is, on the flange 53 or 54 in order to discriminate the electrical directivity.

The first to fourth dividing grooves 57*a*, 57*b*, 58*a*, 58*b*, 512*a*, 512*b*, 513*a*, and 513*b* are further extended on the inclined surfaces 53*c*1 and 54*c*1 of the flanges 53 and 54, respectively. The boundaries between these dividing grooves and the first to fourth winding-around grooves 515*a* to 515*d* are located on the inclined surfaces 53*c*1 and 54*c*1, respectively. Accordingly, each of the first to fourth coils 517 to 519 is entirely covered with the outer covering film 521 from one end thereof to the other end without the coils 517 to 519 being exposed to the mounting surface, to be protected.

Figure 12A:
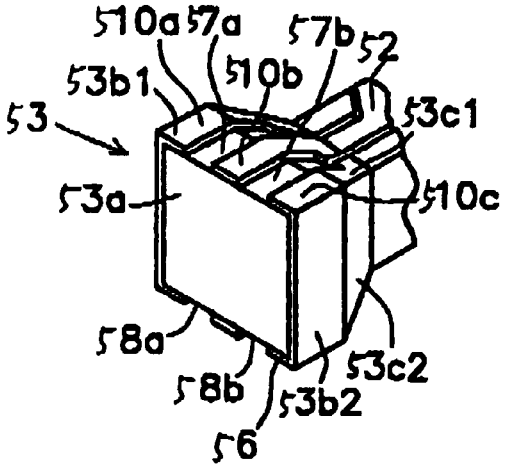
FIG. 12A is a perspective view of a modification example of the coil component of FIG. 7.
Figure 12B:
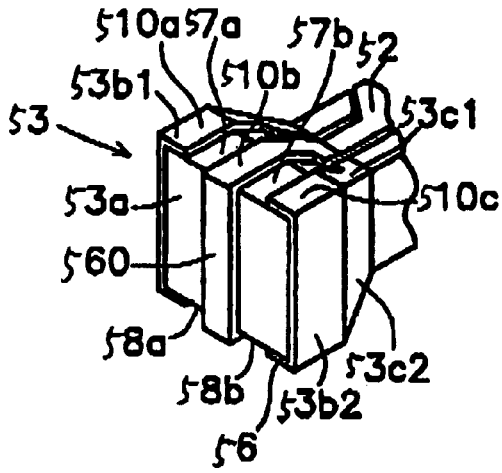
FIG. 12B is a perspective view of another modification example of the coil component of FIG. 7.

As shown in FIG. 12A, in the flange 53, the conductor film 56 may be formed only on the side surfaces 53*b*1 and 53*b*2 and the inclined surfaces 53*c*1 and 53*c*2, the first dividing grooves 57*a* and 57*b* and the second dividing grooves 58*a* and 58*b* are formed, and as shown in FIG. 12B, a strip conductor 560 is formed on the end surface 53*a* of the flange 53 by plating or other such processes. Accordingly, a first terminal 510*a* and a third terminal 510*c* which are not extended on the end surface 53*a* of the flange 53, and also a second terminal 510*b* further extending on the end surface 53*a* of the flange 53 are formed. Fourth to sixth terminals 511*a* to 511*c* provided on the flange 54 may have the same configuration as described above.

Hereinafter, the configuration of a coil component according to a second preferred embodiment of the present invention will be described with reference to FIGS. 13, 14A, 14B, and 15. Similar elements in FIGS. 7 to 10 are designated by similar reference numerals, and description of the similar elements is omitted.

Figure 13:
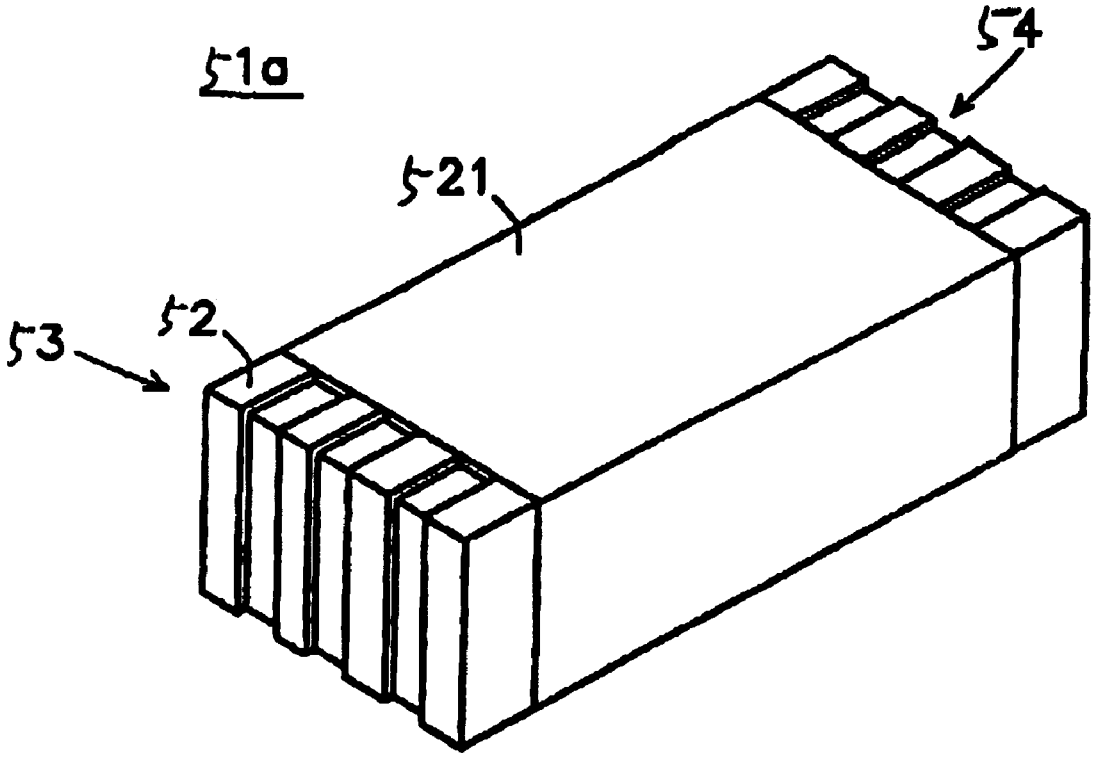
FIG. 13 is a perspective view of a coil component according to a second preferred embodiment of the present invention.

In FIG. 13, a coil component 51*a* preferably includes a core 52, and an outer covering film 52 that covers a portion of the core 52.

Figure 14A:
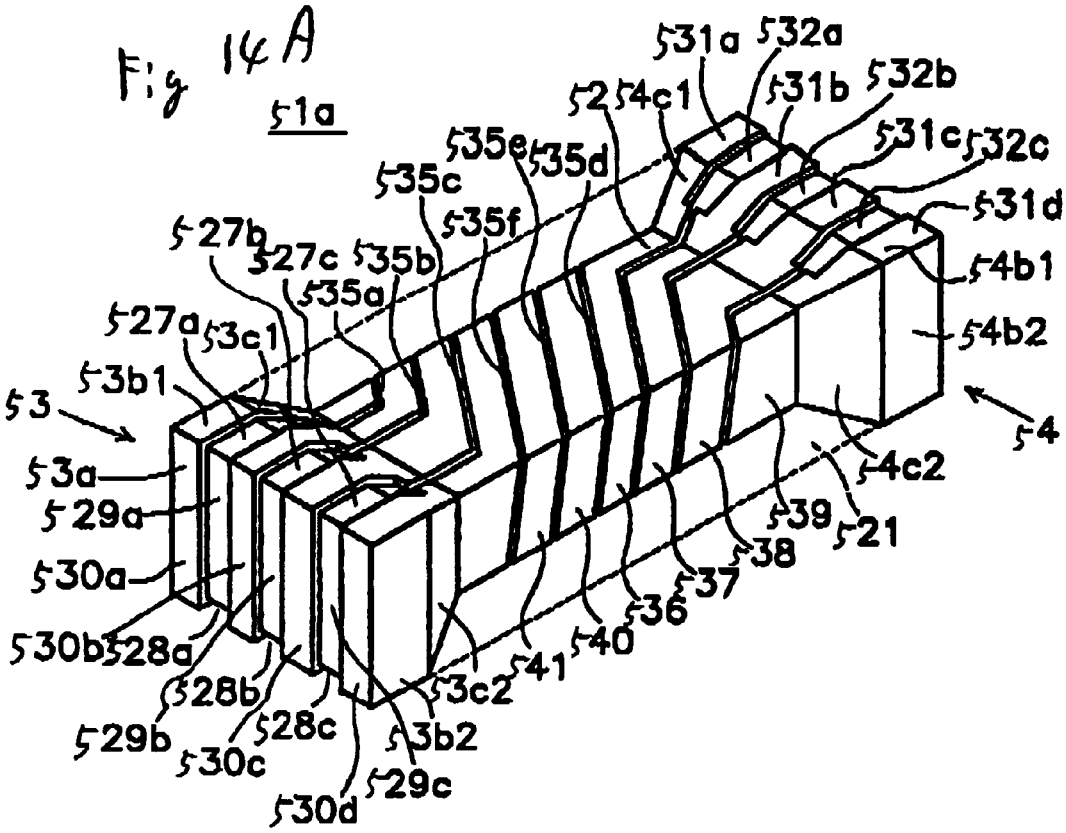
FIG. 14A is a partially perspective view of the coil component of FIG. 13, viewed from one end side in the longitudinal direction thereof.
Figure 14B:
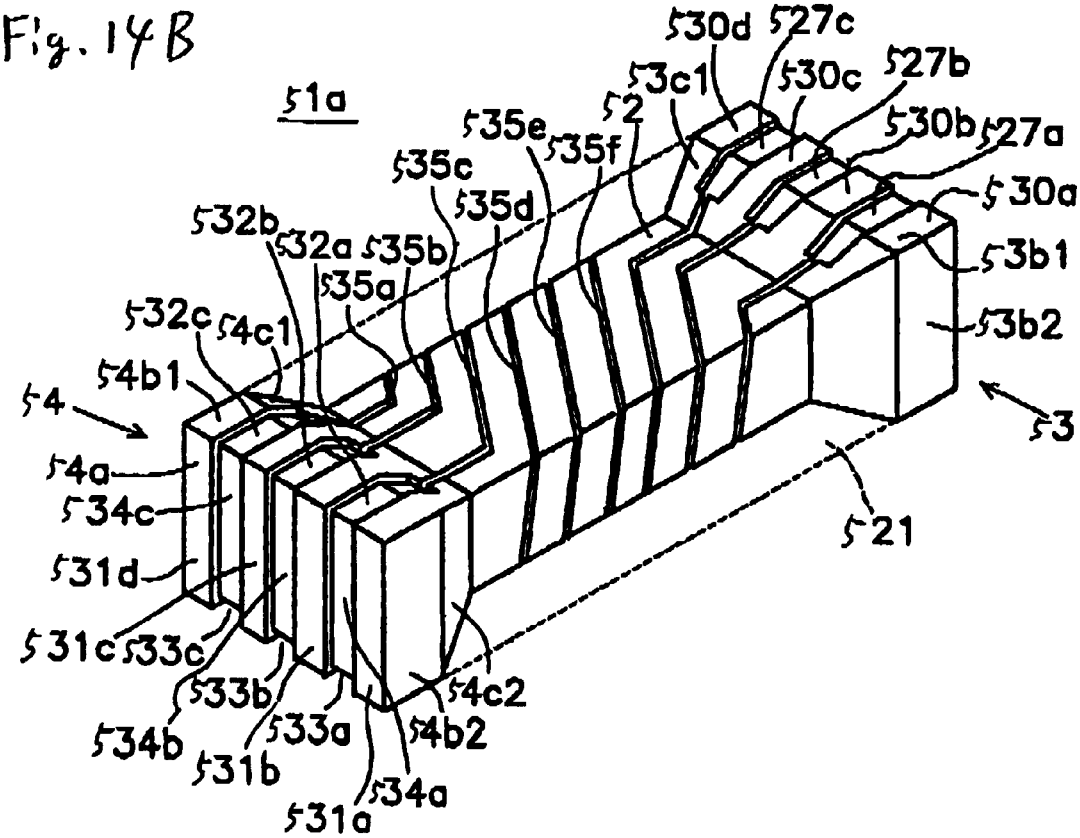
FIG. 14B is a partially perspective view of the coil component of FIG. 13, viewed from the other end side in the longitudinal direction thereof.

The core 52 preferably has a substantially quadratic prism shape with four side surfaces 52*a*, 52*b*, 52*c*, and 52*d*, as shown in FIGS. 14A and 14B. Flanges 53 and 54 each have a substantially drum shape configuration and are disposed on the core 52. The flange 53 has an end surface 53*a*, a pair of side surfaces 53*b*1, a pair of side surfaces 53*b*2, a pair of inclined surfaces 53*c*1, and a pair of inclined surfaces 53*c*2. Similarly, the flange 54 has an end surface 54*a*, a pair of side surfaces 54*b*1, a pair of side surfaces 54*b*2, a pair of inclined surfaces 54*c*1, and a pair of inclined surfaces 54*c*2.

In the flange 53, a first terminal 530*a*, a second terminal 530*b*, a third terminal 530*c*, and a fourth terminal 530*d* are formed by providing first dividing grooves 527*a*, 527*b*, and 527*c*, second dividing grooves 528*a*, 528*b*, and 528*c*, and first connecting grooves 529*a*, 529*b*, and 529*c*, respectively. In the flange 54, a fifth terminal 531*a*, a sixth terminal 531*b*, a seventh terminal 531*c*, and an eighth terminal 531*d* are formed by providing third dividing grooves 532*a*, 532*b*, and 532*c*, fourth dividing grooves 533*a*, 533*b*, and 533*c*, and second connecting grooves 534*a*, 534*b*, and 534*c*. In the portion of the core 52 sandwiched between the flanges 53 and 54, first to sixth coils 536 to 541 are formed by providing first to sixth winding-around grooves 535*a* to 535*f*.

A coat film made of glass is provided on the surface of the core 52, and a conductor film is formed on the coat film, though not shown. The conductor film preferably includes a first conductor film formed on the entire surface of the core 52, and a second conductor film overlapping the first conductor film in the flanges 53 and 54.

Figure 15:
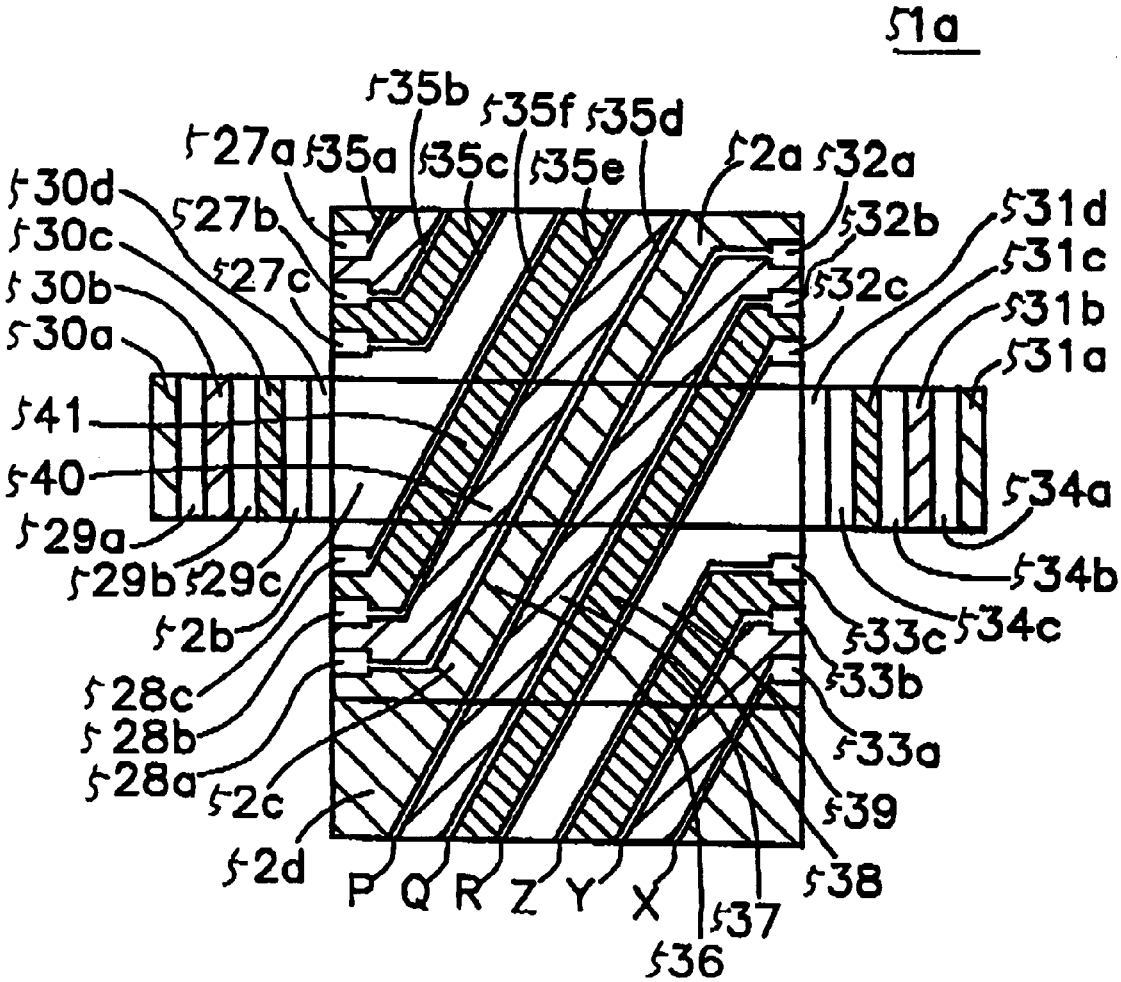
FIG. 15 is a developed schematic view of the coil component of FIG. 13.

A portion of the conductor film is irradiated with a laser beam. The respective grooves are formed by removing the irradiated portion. Hereinafter, the configurations of the respective grooves will be described with reference to FIGS. 14A and 14B, and FIG. 15. FIG. 15 shows the core 52 developed in order to facilitate the understanding of the configurations. The flanges 53 and 54 are shown assuming that they are on the same plane as the core without the concavities and convexities of the flanges being shown.

In the flange 53, the first dividing grooves 527*a* to 527*c* and the second dividing grooves 528*a* to 528*c* are formed in the conductor film, extending on a pair of the opposed side surfaces 53*b*1 and a pair of the inclined surfaces 53*c*1. The connecting grooves 529*a* to 529*c* connecting these dividing grooves to each other are formed in the end surface 53*a*. These grooves and the connecting grooves extending form first to fourth terminals 530*a* to 530*d* insulated from each other in the flange 53.

Further, in the flange 54, the third dividing grooves 532*a* to 532*c* and the fourth dividing grooves 533*a* to 533*c* are formed in the conductor film, extending on a pair of the opposed side surfaces 54*b*1 and a pair of the inclined surfaces 54*c*1. In the end surface 54*a*, the connecting grooves 534*a* to 534*c* connecting these dividing grooves to each other are formed. With these grooves, fifth to eighth terminals 531*a* to 531*d*, which are insulated from each other, are formed in the flange 54.

Further, in the conductor film on the respective side surfaces of the core 52, first to sixth winding-around grooves 535*a* to 535*f* are arranged so as to wind around the core 52 and to not cross each other. The first winding-around groove 535*a* is extended from the end of the first dividing groove 527*a* on the inclined surface 53*c*1 of the flange 53 onto the side surface 52*a* of the core 52, and via the point P on the tangential line between the side surface 52*a* and the side surface 52*d* of the core 52, passed through the side surfaces 52*d*, 52*c*, and 52*b*, and returned to the side surface 52*a*, and connected to the third dividing groove 532*a* on the inclined surface 54*c*1 of the flange 54. Further, the second winding-around groove 535*b* is extended from the end of the first dividing groove 527*b* on the inclined surface 53*c*1 of the flange 53, and via the point Q, passed through the side surfaces 52*d*, 52*c*, and 52*b*, and connected to the third dividing groove 532*b* on the inclined surface 54*c*1 of the flange 54. Further, the third winding-around groove 535*c* is extended from the end of the first dividing groove 527*c*, and via the point R, passed through the side surface 52*d*, 52*c*, and 52*b*, and connected to the third dividing groove 532*c*.

The fourth winding-around groove 535*d* is extended from the end of the second dividing groove 528*a* on the inclined surface 53*c*1 of the flange 53 onto the side surface 52*c* of the core 52, passed through the side surfaces 52*b* and 52*a*, and via the point X on the tangential line between the side surface 52*a* and the side surface 52*d*, passed through the side surfaces 52*d*, returned to the side surface 52*c*, and connected to the fourth dividing groove 533*a* on the inclined surface 54*c*1 of the flange 54. The fifth winding-around groove 535*e* is extended from the end of the second dividing groove 528*b*, passed through the side surfaces 52*c*, 52*b*, and 52*a* of the core 52, and via the point Y, connected to the fourth dividing groove 533*b*. The sixth winding-around groove 535*f* is connected via the point Z to the fourth dividing groove 533*c*.

With the first to sixth winding-around grooves 535*a* to 535*f*, the first to sixth coils 536 to 541 are arranged so as not to cross each other. In FIG. 15, the first to sixth coils 536 to 541 are shadowed for easy discrimination, respectively.

The first coil 536, one end of which is connected to the first terminal 530*a*, is wound around the side surfaces 52*d*, 52*c*, 52*b*, and 52*a* of the core 52, and the other end is connected to the fifth terminal 531*a*. The second coil 537, one end of which is connected to the second terminal 530*b*, is wound around the side surfaces 52*a*, 52*d*, 52*c*, and 52*b* of the core 52, and returned to the side surface 52*a*. The other end is connected to the sixth terminal 531*b*. The third coil 538, one end of which is connected to the third terminal 530*c*, is wound around the side surfaces 52*a*, 52*d*, 52*c*, and 52*b* of the core 52, and returned to the side surface 52*a*. The other end is connected to the seventh terminal 531*c*. The fourth coil 539, one end of which is connected to the fourth terminal 530*d*, is wound around the side surfaces 52*b*, 52*a*, 52*d*, and 52*c* of the core 52, and returned to the side surface 52*b*. The other end is connected to the eighth terminal 531*d*.

The fifth coil 540, one end of which is connected to the second terminal 530*b*, is wound around the side surfaces 52*c*, 52*b*, 52*a*, and 52*d* of the core 52, and returned to the side surface 52*c*. The other end is connected to the sixth terminal 531*b*. The sixth coil 541, one end of which is connected to the third terminal 530*c*, is wound around the side surfaces 52*c*, 52*b*, 52*a*, and 52*d* of the core 52, and returned to the side surface 52*c*. The other end is connected to the seventh terminal 531*c*.

Both ends of the second coil 537 and both ends of the fifth coil 540 are connected to each other through the second terminal 530*b* and the sixth terminal 531*b*, respectively, so as to be integrated with each other. Both ends of the third coil 538 and both ends of the sixth coil 541 are connected to each other through the third terminal 530*c* and the seventh terminal 531*c* so as to be integrated with each other.

Figure 16:
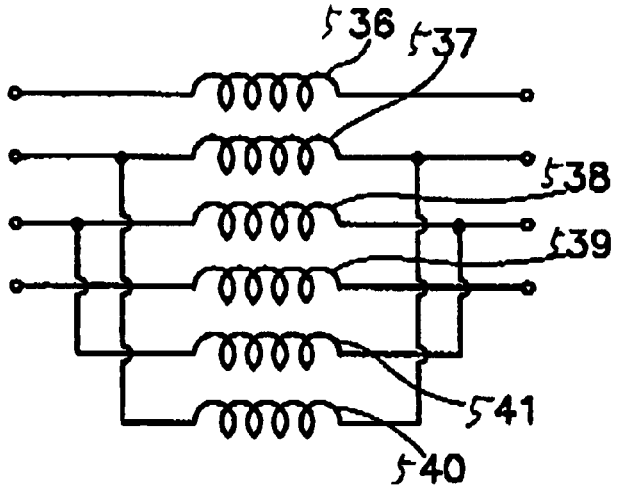
FIG. 16 is an equivalent circuit diagram of the coil component of FIG. 13.

FIG. 16 shows an equivalent circuit of the coil component 51*a*. In FIG. 16, the first to the fourth coils 536 to 539 define independent coils. The fifth coil 540 is connected in parallel to the second coil 537. The sixth coil 541 is connected in parallel to the third coil 538.

In two sets of the coils arranged integrally as described above, the same current-carrying capacity can be obtained even if the widths of the coils are reduced to half thereof, respectively. Accordingly, the area of the core 52 occupied by the conductor can be decreased. That is, the size of the coil component 51*a* can be reduced. If the widths of the coils are not changed, twice as much current-carrying capacity can be obtained.

The coil component 51*a* has the same advantages as those of the coil component 51, in addition to the above-described advantages.

In the above-described preferred embodiments, examples are described such that each of the winding-around grooves and the coils formed in the conductor of the core has both ends thereof positioned on the same side surface of the core. However, one end and the other of each of the winding-around grooves and the coils may be formed on the opposite side surfaces.

Figure 17:
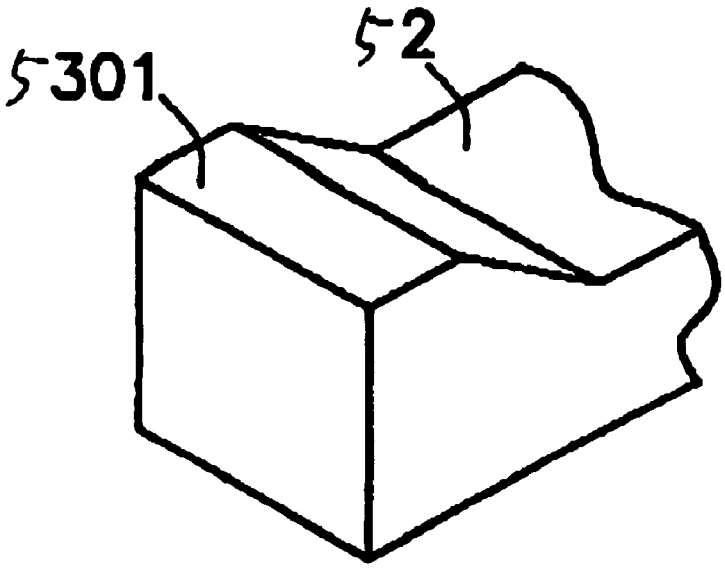
FIG. 17 is a perspective view showing a portion of the core constituting a coil component according to another preferred embodiment of the present invention.
Figure 18:
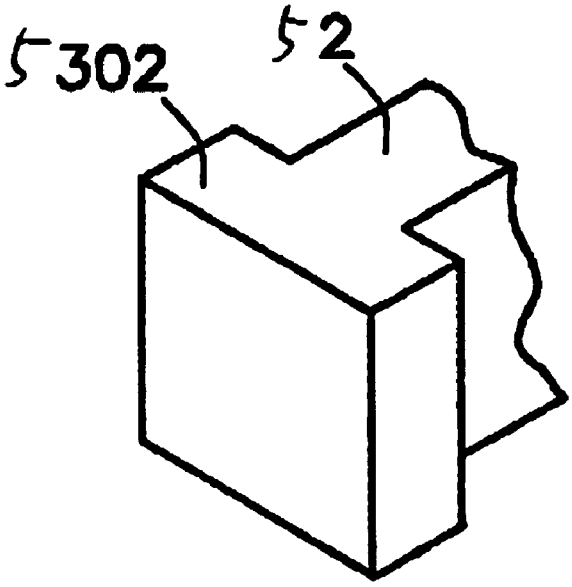
FIG. 18 is a perspective view showing a portion of the core constituting a coil component according to a further preferred embodiment of the present invention.

The shape and size of each flange provided for the core is not restricted to that described in the above preferred embodiments. For example, the flange may have the same shape and size as that of a flange 5301 shown in FIG. 17 or that of a flange 5302 shown in FIG. 18.

Figure 19:
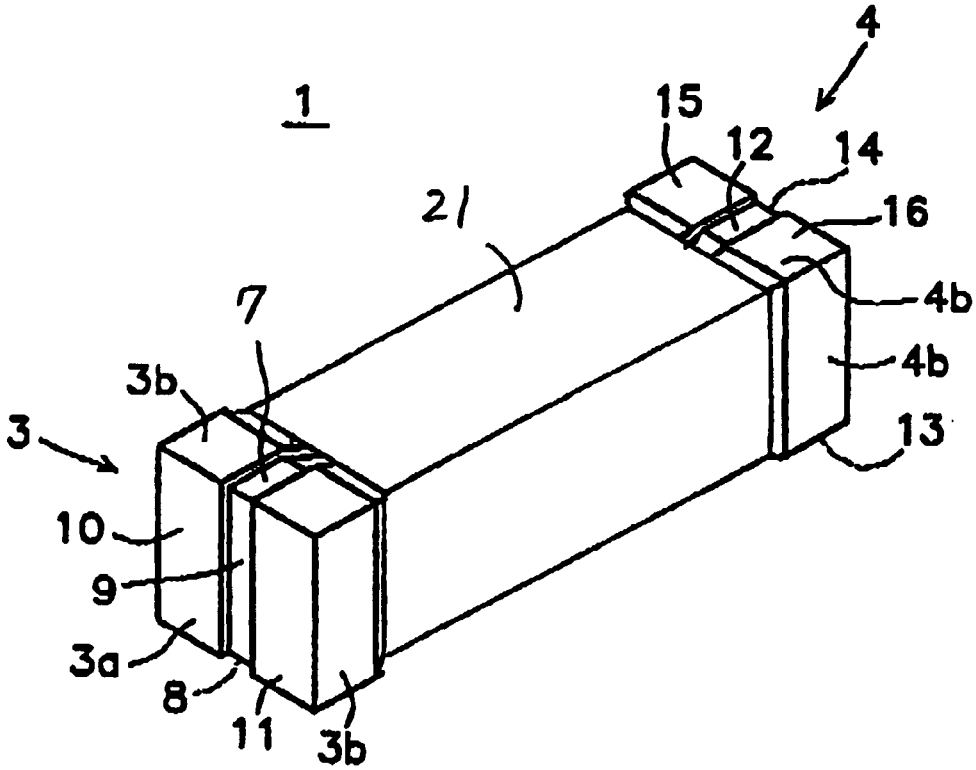
FIG. 19 is a perspective view showing still a further preferred embodiment of the present invention.
Figure 20:
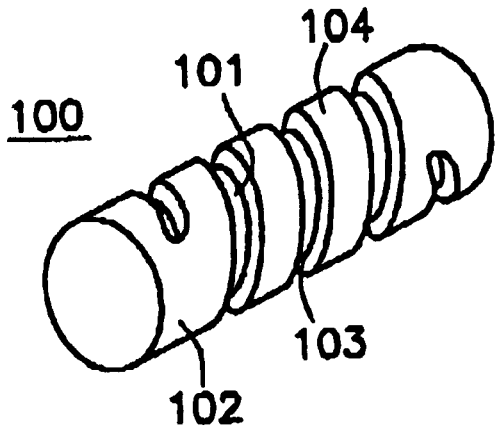
FIG. 20 is a perspective view of a conventional coil component.

In the above-described preferred embodiments, the surface of each outer covering film may be positioned near to the center axis of the core, not on the same plane as the surface of the flanges. That is, for example, the outer covering film may be depressed from the surfaces of the flanges, as shown in FIG. 19.

The material for forming the core may be a magnetic material excluding the ferrite. The core may be formed from glass, a dielectric, plastic, alumina, or other suitable material. In the case where the core is formed from glass or alumina, there is no possibility that the insulation resistance is reduced by the laser beam working, and thereby, it is not necessary to form the coat film on the surface of the core. In this case, the conductor film is formed directly on the surface of the core. The shape of the core is not restricted to a prism. The core may have a column or other shape.

According to preferred embodiments of the present invention, a coil component including a plurality of coils and a plurality of terminals connected to the plurality of coils is provided.

The plurality of coils are arranged so as to be substantially parallel to each other. Accordingly, the coupling degree between the coils is high, and distributed capacitances between the coils are equally generated. Thus, a distributed constant type coil component can be provided.

Preferably, the widths of the dividing grooves on the core are larger those that of each of the winding-around grooves, respectively. For this reason, in the case where the winding-around grooves are formed so as to be connected to the dividing grooves by means of a laser beam, respectively, the winding-around grooves can be securely connected to the dividing grooves, even if the irradiation position of the laser beam is departed, provided that the departure is within a predetermined range.

When the core is formed of a magnetic material or a dielectric material, a coat film made of glass is provided on the surface of the core. Hence, even if the magnetic material or a dielectric is modified by a laser beam applied for formation of the winding-around grooves on the core, and the insulation resistance of the core is reduced, the coat film assures the required insulation resistance. Accordingly, the insulation resistance between a pair of coils can be set at a desired value.

In the coil component of preferred embodiments of the present invention, the end surface of each flange provided for the core may have a substantially quadrangle shape, and preferably a substantially rectangular shape, whereby the electrical directivity can be easily discriminated. In the process of forming the respective winding-around grooves, the directivity can be discriminated securely and accurately when the core is supplied to a working machine. Further, when the coil component is mounted onto a printed circuit board, the discrimination of the directivity can be easily performed.

Preferably, the boundaries between the dividing grooves and the winding-around grooves provided on the core lie on the inclined surfaces of one pair of the flanges protruding from the core. For this reason, when the outer covering is filled into the portion of the core sandwiched between the flanges, coils defined by the winding-around grooves are entirely covered from one end thereof to the other with the outer covering film, and are not exposed to the mounting surface, so as to be protected.

Preferably, the portion of the core sandwiched between the flanges is provided with an outer covering film, and the surface of the outer covering film is on the same plane as the surfaces of the flanges, or is depressed from the surfaces of the flanges toward the approximately center axis of the core. Accordingly, the height of the coil component is minimized.

In the coil component of preferred embodiments of the present invention, different static capacitances can be realized by selecting materials having different dielectric constants for the core or the outer covering film. Thus, the distributed constant of the coil component can be set at a desired value.

It should be understood that the foregoing description is only illustrative of the present invention. Various alternatives and modifications can be devised by those skilled in the art without departing from the invention. Accordingly, the present invention is intended to embrace all such alternatives, modifications and variations which fall within the scope of the appended claims.

What is claimed is:

1. A coil component comprising:

a columnar core having a conductor film disposed thereon;

first and second terminals insulated from each other, provided on the conductor film at one end portion of the core, and defined by a first dividing groove and a second dividing groove provided in the conductor film at said one end portion of the core;

third and fourth terminals insulated from each other, provided on the conductor film at the other end portion of the core, and defined by a third dividing groove and a fourth dividing groove provided in the conductor film at said other end portion of the core;

a first winding-around groove provided in the conductor film extending from the first dividing groove to the third or fourth dividing groove, and being continuous with the first and third or fourth dividing grooves;

a second winding-around groove provided in the conductor film extending from the second dividing groove to the fourth or third dividing groove, and being continuous with second and fourth or third dividing grooves, wherein said second winding-around groove extends substantially parallel to the first winding-around groove; and a first coil and a second coil arranged substantially parallel to each other and defined by the first and second winding-around grooves.

2. A coil component according to claim 1, wherein a total of at least three terminals, which are insulated from each other, are defined by at least two first dividing grooves and at least two second dividing grooves, a total of at least three terminals which are insulated from each other are defined by at least two third dividing grooves and at least two fourth dividing grooves, and at least four winding-around grooves arranged substantially parallel to each other are provided in the conductor film, extending from the first and the second dividing grooves to the third and the fourth dividing grooves, continuously with the dividing grooves, respectively, and at least four coils arranged substantially parallel to each other are defined by said at least four winding-around grooves.

3. A coil component according to claim 1, wherein one end of the first coil is connected to the first terminal, and the other end is connected to the third terminal, and one end of the second coil is connected to the second terminal, and the other end is connected to the fourth terminal.

4. A coil component according to claim 1, wherein one end of the first coil is connected to the first terminal, and the other end is connected to the fourth terminal, and one end of the second coil is connected to the second terminal, and the other end is connected to the third terminal.

5. A coil component according to claim 2, wherein at least one pair of the coils are connected to each other through the terminal on one or the other end side of the core.

6. A coil component according to claim 1, wherein on one end of the core, a first connecting groove connecting the first and second dividing grooves to each other is provided in the conductor film.

7. A coil component according to claim 1, wherein on the other end of the core, a second connecting groove connecting the third and fourth dividing grooves to each other is provided in the conductor film.

8. A coil component according to claim 1, wherein the width of each of the first to fourth dividing grooves is larger than that of each of the winding-around grooves.

9. A coil component according to claim 1, wherein flanges are provided on the one end portion and the other end portion of the core so as to protrude in the radial direction of the core.

10. A coil component according to claim 9, wherein the boundaries between the first to fourth dividing grooves and the winding-around grooves are located in the surfaces of the flanges and are continuous with the surface of the core.

11. A coil component according to claim 10, wherein the surfaces of the flanges that are continuous with the surface of the core are inclined with respect to the radial direction of the core, respectively.

12. A coil component according to claim 9, wherein the flanges each have a substantially rectangular end surface that is substantially parallel to the radial direction of the core.

13. A coil component according to claim 1, wherein the core is made of ferrite, a coat film is provided on the surface of the core, and the conductor film is provided on the coat film.

14. A coil component according to claim 13, wherein the coat film is made of glass.

15. A coil component according to claim 9, wherein the portion of the core sandwiched between the flanges is provided with an outer covering film, and the surface of the outer covering film is on the same plane as the surfaces of the flanges.

16. A coil component according to claim 9, wherein the portion of the core sandwiched between the flanges is provided with an outer covering film, and the covering film is positioned near to the center axis of the core, not on the same plane as the surfaces of the flanges.

* * * * *